US006209508B1

(12) United States Patent
Tinney

(10) Patent No.: US 6,209,508 B1
(45) Date of Patent: Apr. 3, 2001

(54) FOUR-CYCLE FUEL-LUBRICATED INTERNAL COMBUSTION ENGINE

(75) Inventor: Joseph F. Tinney, Arvada, CO (US)

(73) Assignee: Science Applications International Corp., San Diego, CA (US)

( * ) Notice: Subject to any disclaimer, the term of this patent is extended or adjusted under 35 U.S.C. 154(b) by 0 days.

(21) Appl. No.: 08/931,246

(22) Filed: Sep. 16, 1997

Related U.S. Application Data

(63) Continuation of application No. 08/810,244, filed on Mar. 3, 1997, now abandoned.

(51) Int. Cl.[7] ..... F01M 9/04

(52) U.S. Cl. ..... 123/196 S; 123/196 A; 123/73 AD

(58) Field of Search ..... 123/196 R, 196 S, 123/196 A, 73 AD, 41.33

(56) References Cited

U.S. PATENT DOCUMENTS

| | | | |
|---|---|---|---|
| 2,580,572 | 1/1952 | McMillan . | |
| 4,095,571 | 6/1978 | Fleetwood et al. . | |
| 4,417,561 | 11/1983 | Yasuhara . | |
| 4,421,078 | 12/1983 | Hurner . | |
| 4,495,909 | 1/1985 | Hurner . | |
| 4,572,120 | 2/1986 | Matsumoto . | |
| 4,615,305 | 10/1986 | Matsumoto . | |
| 4,666,019 | 5/1987 | Schaller . | |
| 4,674,456 | 6/1987 | Merritt . | |
| 4,730,580 * | 3/1988 | Matsushita | 123/73 AD |
| 4,869,346 | 9/1989 | Nelson . | |
| 4,890,695 | 1/1990 | Morris et al. . | |
| 5,203,429 | 4/1993 | Zager . | |
| 5,238,085 | 8/1993 | Engelmann . | |
| 5,238,712 | 8/1993 | Smith et al. . | |
| 5,353,760 | 10/1994 | Zager . | |
| 5,390,762 | 2/1995 | Nelson . | |
| 5,431,138 * | 7/1995 | Hurner | 123/196 S |
| 5,476,073 * | 12/1995 | Betts | 123/73 AD |
| 5,720,249 | 2/1998 | Betts et al. . | |

OTHER PUBLICATIONS

"Lubricity of Jet Fuels," by J.K. Appeldoorn & W.G. Dukek, Esso Research & Engineering Co., pp. 428–440.

* cited by examiner

*Primary Examiner*—Erick Solis
(74) *Attorney, Agent, or Firm*—Banner & Witcoff, Ltd.

(57) ABSTRACT

A four-cycle, fuel lubricated, internal combustion engine system suited for a vehicle includes a fuel tank containing fuel at a remote location from the engine, a first fluid path for transporting fuel to the lubrication system of the engine, and a second fluid path for transporting fuel to said combustion system of the engine. In this way, the engine's fuel serves as the lubricant and the combustive agent.

23 Claims, 4 Drawing Sheets

FOUR-CYCLE FUEL-LUBRICATED INTERNAL COMBUSTION ENGINE

This is a continuation of application Ser. No. 08/810,244, filed on Mar. 3, 1997, now abandoned.

FIELD OF THE INVENTION

The present invention relates to a four-cycle, internal combustion engine.

BACKGROUND OF THE INVENTION

In a conventional four-cycle internal combustion engine, the fuel and lubricating systems are maintained completely separate. Despite wide use, this division in the modern engine entails a number of shortcomings. For example, the oil is relied upon to not only reduce friction and wear, but also to serve as a coolant, an oxidation and corrosion inhibitor, and a transport fluid that removes wear metal particles and blow-by products (e.g., carbon, sludge, varnish, unburned fuel, and other combustion products) for subsequent filtration. Due to these requirements on the oil, the engine oil additives become depleted and the important characteristics of the lubricant are degraded. As a result, the oil over time will tend to experience an increase in viscosity and an accumulation of abrasive particles and oxides which, in turn, leads to the corrosion of engine components and increased wear. Moreover, replacement of the oil creates an added expense and a disposal problem with regard to the used oil. Finally, vehicles which are old or poorly maintained can experience considerable burning of the oil which leads to tailpipe emission problems.

A few engine systems have mixed oil and fuel together to facilitate oil replacement while the engine is in use. For instance, U.S. Pat. Nos. 5,431,138, 4,421,078, 4,869,346 and 4,495,909 disclose systems which pump a quantity of used oil into a fuel return line as the engine operates. Fresh oil in predetermined batches is also fed into the lubricating system to offset the oil which is removed. However, the maintenance of two fluid systems is still required. Moreover, as discussed above, the burning of oil creates undesirable pollution problems.

U.S. Pat. Nos. 4,572,120 and 4,615,305 to Matsumoto each discloses an outboard motor provided with a lubricant delivery tank mounted on the motor, and a storage tank which is mounted in the hull and fluidly coupled to the delivery tank. A pump feeds the lubricant in the delivery tank into the intake manifold of the motor. However, the outboard motor is a two-cycle engine, rather than a four-cycle engine. Moreover, this system requires the maintenance of separate oil and fuel systems and involves the burning of oil in the motor.

Other two-cycle, internal combustion engines have been produced which use an oil-fuel mixture for both lubrication and powering of the motor. However, these two-cycle engines are much different than modern four-cycle, internal combustion engines. For instance, these engines lack valves, rely upon oil-rich mixtures, and are very dirty engines which are not suitable for the high pollution standards now in existence for vehicles and other large engine applications.

Also, fuel lubrication is known to have advantages for an internal combustion engine, especially a diesel fuel engine. As a result, most diesel fuels have high lubricity, or contain lubrous additives, to ensure that the fuel injector pump and fuel injectors are adequately lubricated during normal operation. However, no four-cycle, internal combustion engine has been used in which the fuel serves as the lubricant for the engine.

SUMMARY OF THE INVENTION

A primary object of the present invention is to provide a four-cycle, internal combustion engine in which the engine's fuel serves as the lubricant and the combustive agent.

A further object of the present invention is to provide a fuel lubricated, four-cycle, internal combustion engine which has a system for maintaining a desired quantity of clean lubricant (fuel) in the lubrication system.

These as well as other objects are accomplished by an engine system which comprises a fuel tank containing fuel at a remote location from the engine, a first fuel path to convey fuel to the lubricating system of the engine, and a second fuel path to convey fuel to the engine for combustion. In one preferred construction, the fuel is first directed into the lubricating system for lubricating the engine, and then to the combustion system for powering the engine.

In an alternative construction, the fuel tank is fluidly coupled to provide fresh fuel to both the lubricating system and the combustion system. A fuel return line is also provided to transport fuel used in the lubricating system to the fuel supply line for powering the engine with a mixture of fresh fuel and fuel used as a lubricant.

By using a single fluid to power and lubricate an engine, the expense of maintaining two separate systems is eliminated. Since the lubricating fluid is constantly removed and replaced with fresh fuel, oil changing and disposal problems are eliminated. The constant exchange of fuel in the lubricating system also keeps contaminants in the lubricant to a low level which permits the elimination of an oil filter. Moreover, in view of the constant turn over of lubricant in the lubricating system and the low level of contaminants, the lubricant is not subject to undue degradation. Finally, the undesired exhaust produced from burning oil is completely obviated in the present system.

DETAILED DESCRIPTION OF THE PREFERRED EMBODIMENTS

The present invention pertains to a four-cycle, internal combustion engine that is lubricated by the fuel. The inventive system is best suited for a diesel engine, but could also be used in gasoline or alternative fuel (e.g., natural gas, biodiesel, etc.) powered, four-cycle, internal combustion engines.

Figure 1:
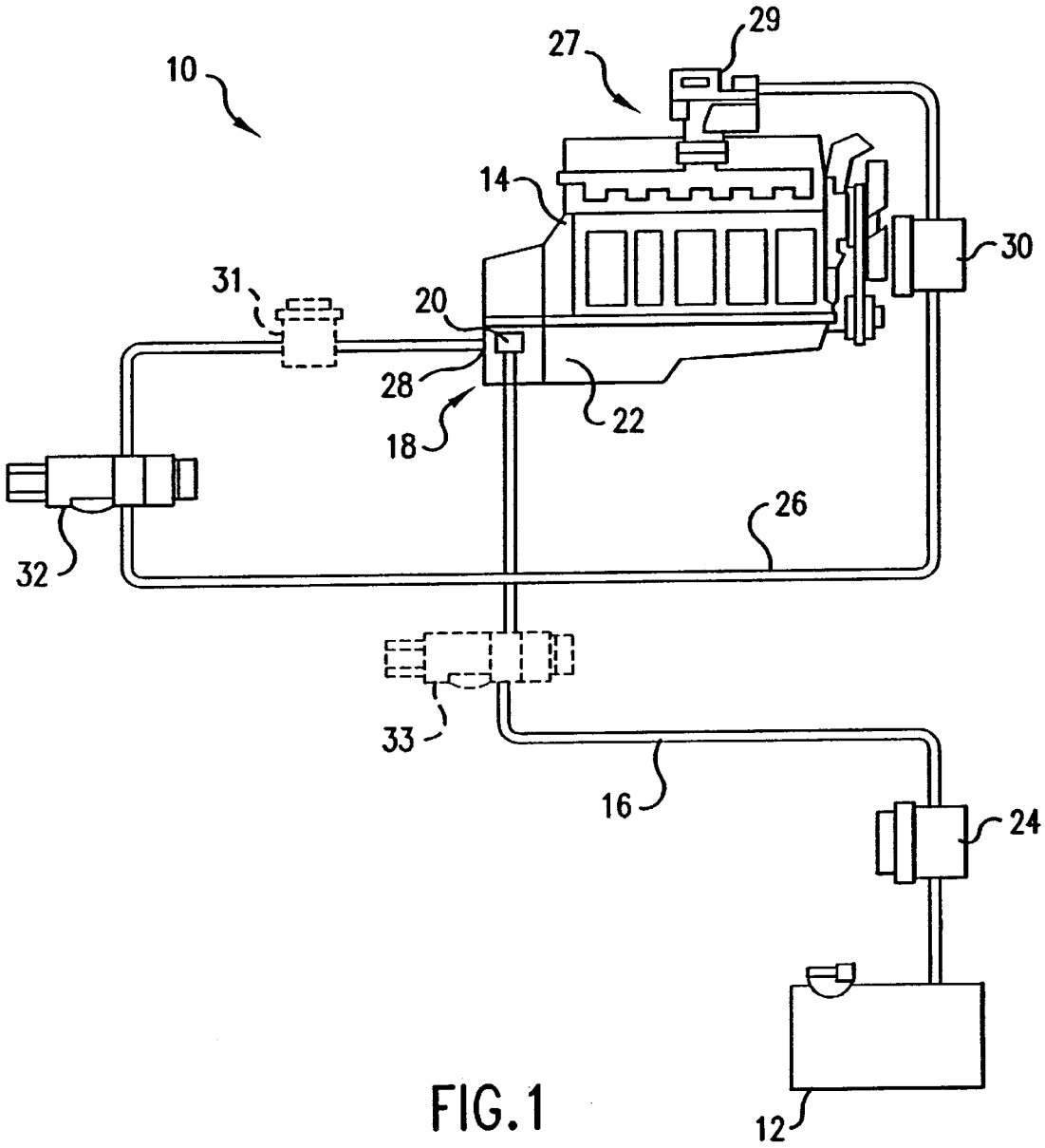
FIG. 1 is a schematic view of an engine system of a preferred embodiment of the present invention.

In the preferred embodiment, the present engine system 10 (FIG. 1) includes a fuel tank 12 which contains fuel at a location that is remote from a four-cycle, internal combustion, diesel engine 14. A diesel fuel, such as JP–8 (a fuel commonly used in military vehicles) or a fuel of similar lubricity can be used in an engine manufactured in accordance with the present invention. It is believed that a fuel having a viscosity in the range of about 1.5 to 4.5 centistokes would be suitable for use in the present invention. However, any fuel for an internal combustion engine which has sufficient lubricity to enable its use in the lubrication system of a four-cycle, internal combustion engine could be used in the present system.

In a preferred construction, a first fuel line 16 fluidly connects fuel tank 12 to the lubrication system 18 of engine 14. Fuel line 16 is preferably coupled to an inlet port 20 formed in the lubricant pan 22. Lubricant pan 22 defines a reservoir of the fuel to be used in lubricating the engine. Fuel pump 24 is installed along fuel line 16 to pump the fuel from tank 12 to pan 22. A conventional lubrication pump (not shown) would be used to convey the fuel through the lubrication system.

A second fuel line 26 couples the lubrication system 18 to the combustion system 27 of engine 14 in order to transport fuel, for example, to a fuel injector 29. Fuel line 26 draws fuel from pan 22 via outlet port 28. The turbulence within pan 22 is generally sufficient to amply mix the fuel and prevent channeling whereby the fresh fuel would flow directly from inlet port 20 to outlet port 28. Nonetheless, fuel line 26 could alternatively be connected to the lubrication system 18 via a port located outside of pan 22. For instance, line 26 could connect to a port at a location where the conventional oil filter would ordinarily mount.

Since fresh fuel is continually circulated into and out of the lubrication system, fouling and degradation of the lubricant (i.e., fuel) is avoided. Moreover, the conventional lubricant filter can be eliminated. Nevertheless, if desired, a filter could still be included in the lubrication system for additional protection. A conventional fuel filter 30 is positioned in line 26 to remove contaminants. Although diesel fuel is normally suitable for direct use as an engine lubricant, a fuel filter in fuel line 37, downstream of fuel pump 51, could be used to remove contaminants from the fresh fuel to be used as a lubricant.

Pan 22 includes a fluid level sensor (not shown) which senses when the fuel reaches a predetermined lower level. The sensor would be used to not only activate a warning light and/or gauge, but also to close valve 32 in fuel line 26 to prevent the removal of too much fuel from the lubrication system. A float valve (not shown) is also preferably included in pan 22 to regulate the flow of fuel into pan 22 through port 20. The float valve acts to close port 20 as the volume of fuel in pan 22 reaches a predetermined upper limit, and open the port as the level of fuel drops in the pan. Alternatively, an upper level sensor (not shown), similar to the low level sensor, can be used to sense a predetermined volume of fluid in pan 22 and electrically signal a valve 33 in line 16 to open and close as needed.

In accordance with engine system 10, fuel in tank 12 is pumped through fuel line 16 by pump 24 and transported to pan 22. Preferably a float valve associated with port 20 regulates the amount of fuel fed into pan 22. While a one-way valve could be provided in line 16 to prevent reverse flow of the fuel to the tank, the pressure produced by pump 24 is generally sufficient to prevent the flow of fluid out of pan 22 and into fuel line 16. A pump (not shown) is used to pump the fuel in pan 22 through the lubrication system 18. A second fuel line 26 is provided to transport fuel from pan 22 to the combustion system 27 of the engine as the sole source of fuel for powering the engine. The pressure in lubricating system 27 is generally suitable for transporting the fuel through line 26 if the line is coupled to the system outside of the pan, such as where the lubrication filter is ordinarily attached. Nevertheless, an additional fuel pump 31 is used to pump the fuel through line 26 when the fuel is drawn from pan 22. Valve 32 is generally open, unless the fuel in pan 22 reaches the predetermined lower limit.

Figure 2:
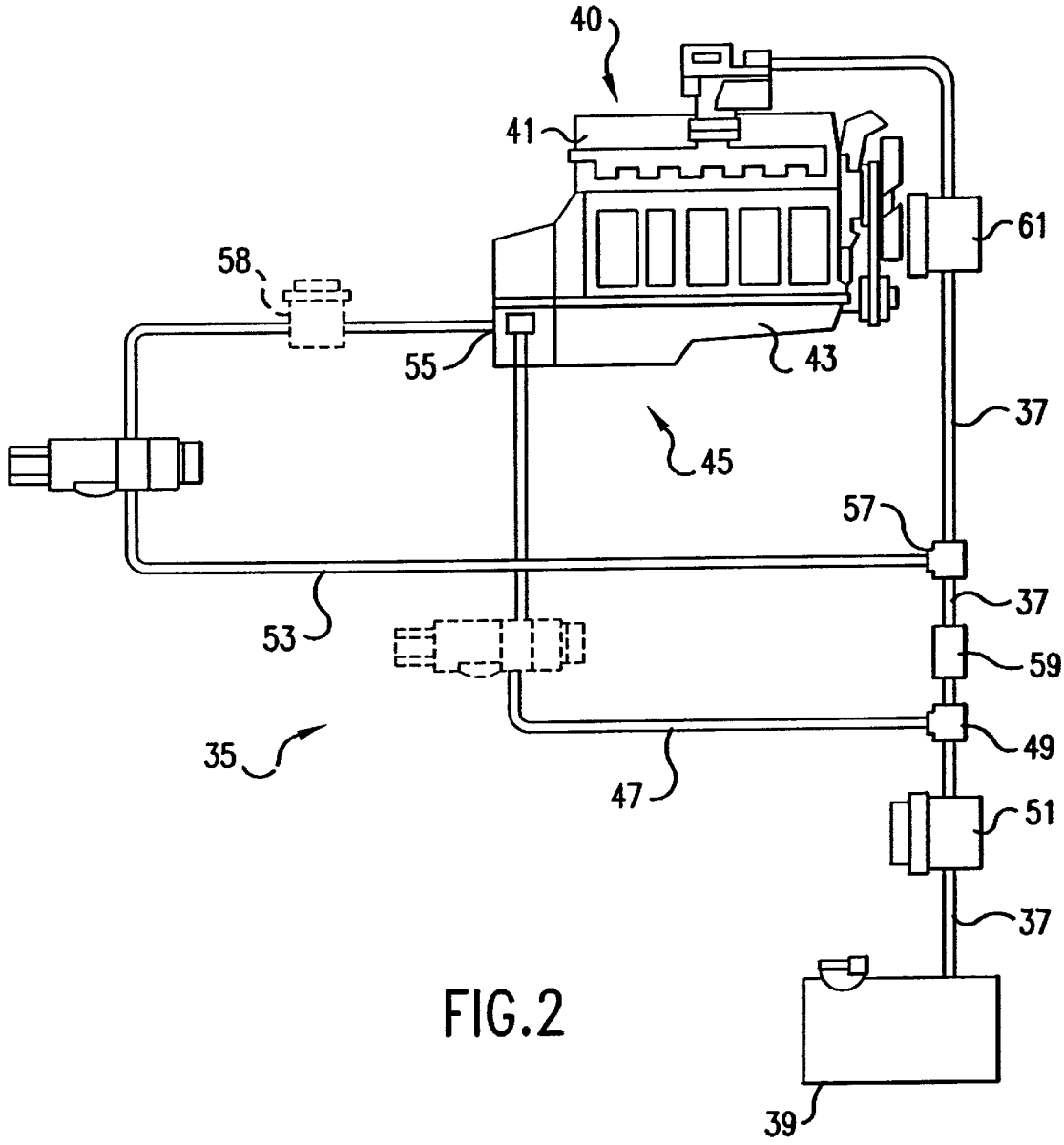
FIGS. 2 and 3 are alternative embodiments of an engine system.

In an alternative engine system 35 (FIG. 2), fuel line 37 transports fuel from fuel tank 39 to combustion system 40 of engine 41 to power the engine. A fuel or lubrication line 47 is joined to fuel supply line 37 by T-connector 49 to transport fresh fuel to the lubricant pan 43 in order to provide fuel to the lubrication system 45. A fuel pump 51 is installed along fuel line 37, upstream of T-connector 49, to pump the fuel through both lines 37 and 47. As an alternative, lubricant line 47 could be fluidly coupled to tank 39 independent of fuel supply line 37. However, this alternative construction would require an additional pump.

A fuel return line 53 is provided to transport fuel from lubrication system 45 to combustion system 40 of engine 41 in order to reuse the lubricating fuel for combustion. Fuel return line 53 is preferably coupled to lubricant pan 43, although other connections to the lubrication system could be made. More specifically, return line 53 draws fuel from pan 43 via port 55 and transports the fuel to supply line 37 via T-connector 57. A one-way valve 59 is provided in line 37, upstream of T-connector 57, to prevent a reverse flow of the fuel used as a lubricant to fuel tank 39. Preferably valve 59 is positioned between connectors 49 and 57 to also prevent recycling of the fuel in line 53 back to pan 43. Sensors and valves for regulating the volume of fuel in the lubricating system 45, as described above for engine system 10, would also be applicable to engine system 35. A fuel filter 61 in fuel line 37, downstream of T-connector 57, removes contaminants from the mixture of fresh fuel and the fuel used as a lubricant. A one-way valve (not shown) could optionally be provided in line 53 to prevent reverse flow of the fluid to pan 43, but is generally unnecessary due to the pressure in line 53. Pressure in line 53 is provided by a separate fuel pump 58, or, by the standard lubricant (oil) pump if exit port 55 is at the normal oil filter location.

Figure 3:
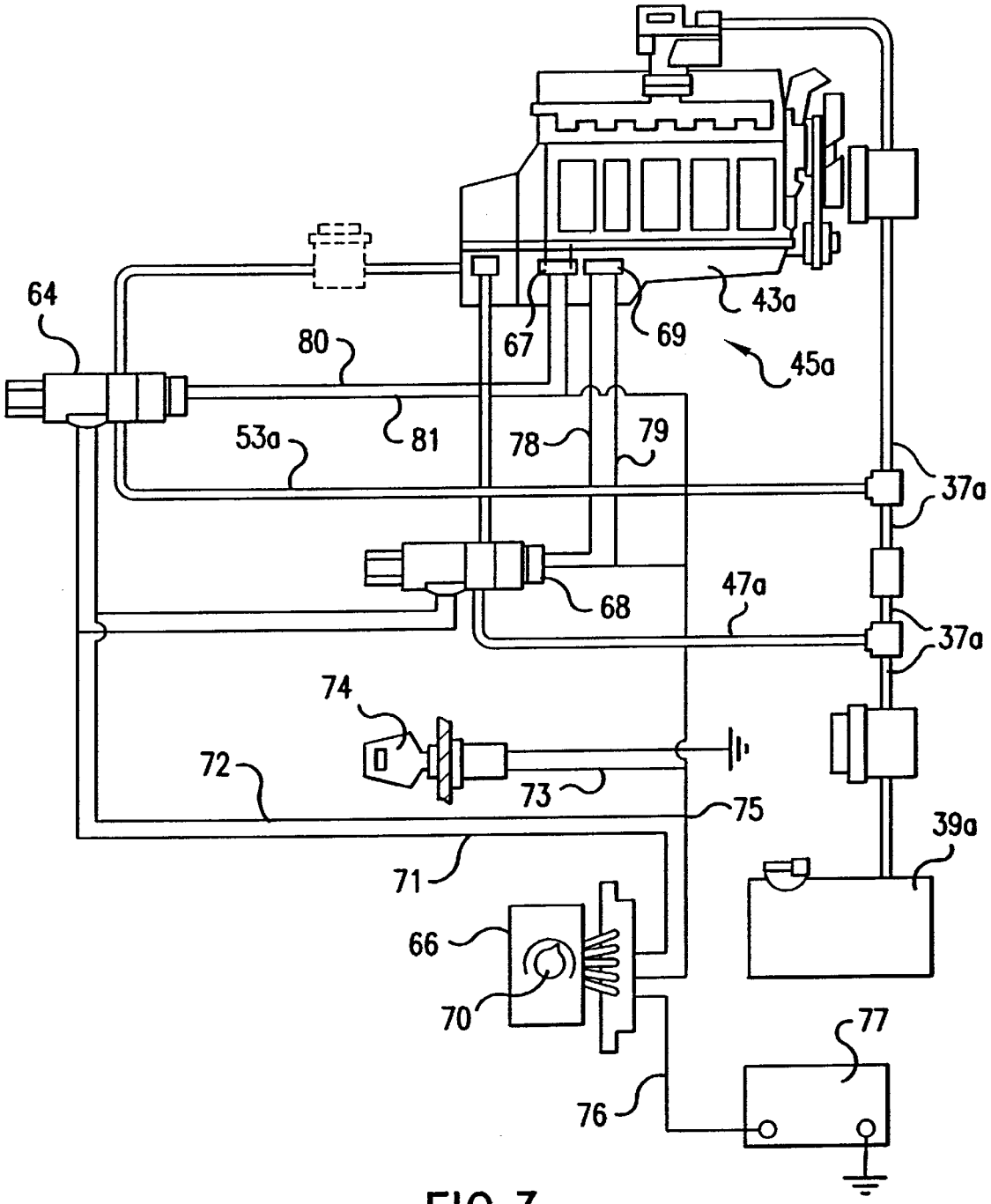

As another alternative (FIG. 3), a valve 64 is provided in return line 53*a* to regulate the flow of fuel from the lubricant pan 43*a* to the fuel supply line 37*a*. Valve 64 is opened intermittently based upon signals from a timer in control module 66. When valve 64 is open, the pressure generated by the lubricating pump (not shown) of the lubrication system 45*a* is sufficient to convey fuel through line 53*a* to mix with the fuel in supply line 37*a*. A valve 68 can also, optionally, be installed in lubrication line 47*a* in place of a float valve. In this arrangement, valve 68 is intermittently opened in response to a regular, periodic signal generated by control module 66. In this way, valve 68 thereby regulates the flow of fluid from the fuel tank 39*a* to the lubricant pan 43*a*.

In this alternative, control module 66 generates a regular, periodic signal at preset time intervals during engine operation to regulate the addition and removal of fuel to and from the engine lubrication system. An impulse timer within the control module 66 dictates the frequency at which a signal is generated. Varying frequencies can be selected by changing the position of a dial 70 located on the control module 66. Accordingly, valves 64 and 68 are intermittently operable in response to this signal during engine operation. The signals to valves 64 and 68 are provided through the electrical connection of the control module 66 with the valves. Specifically, leads 71 and 72 connect module 66 and valves 64, 68. A lead 73 runs from control module 66 to ignition switch 74 and is connected to a lead 72 from valves 64 and 68 at node 75. Lead 76 connects control module 66 to a constant power source 77, such as is readily available in a motor vehicle.

A low fluid sensor 67 is preferably provided in pan 43*a* to indicate when the fuel in pan has reached a predetermined low level. Sensor 67 is electrically coupled to control module 66 (or control valve 64) to override the periodic signal to open valve 64, and thereby prevents any further removal of fuel from the pan 43*a*. The operation of sensor 67 and valve 64 thus prevents emptying of fuel from the lubricating system as fuel in fuel tank 39*a* runs low. A second sensor 69 can also be provided in pan 43*a* to sense when the fuel reaches a predetermined upper limit. The activation of sensor 69 overrides control module 66 (or control valve 68) and prevents valve 68 from being opened and admitting additional fuel into pan 43*a*. Sensors 67, 69 are electrically, by leads 78–81, coupled to valves 64, 68 and control module 66.

Figure 4:
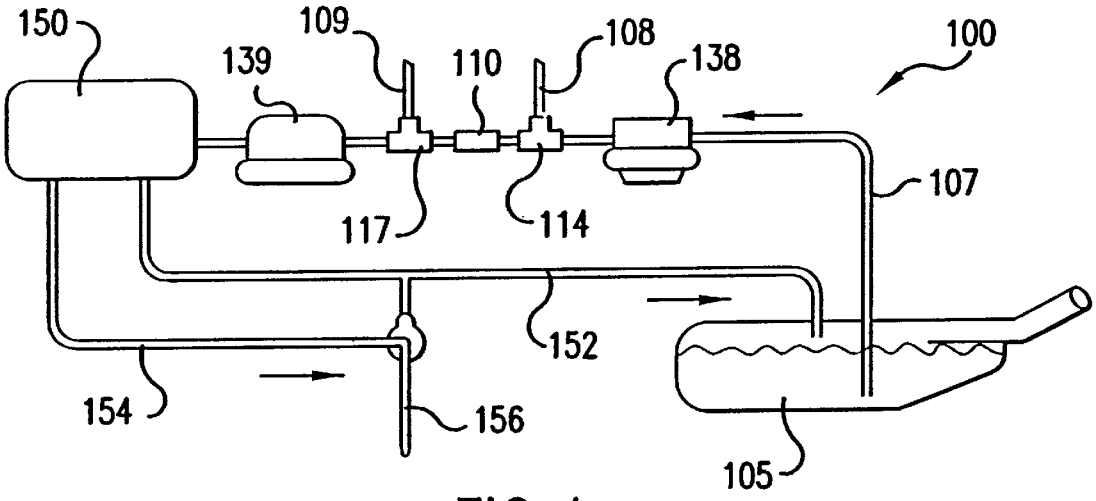
FIGS. 4 and 5 are schematic views of alternate fuel delivery systems.

The present invention may also be used in conjunction with other known engine systems. For example, a lubrication line 108 and return line 109 may be interconnected via connectors 114, 117 to a fuel supply line 107 in engine system 100 (FIG. 4). Engine system 100 includes a fuel tank 105, a fuel pump 138 and a fuel filter 139 located along line 107, and a fuel injection pump 150 located in the engine (not shown). A fuel return 152 extends from the fuel injector pump 150 to the fuel tank 105. An injection line 154 also extends from the injection pump 150 to an injection nozzle 156. As with the earlier systems, connectors 114, 117 are located between the fuel pump and the fuel filter. While a one-way valve 110 is preferably still provided between connectors 114, 117, it is not necessary. In this embodiment, fuel return line 152 permits fuel used as a lubricant to return to fuel tank 105.

Figure 5:
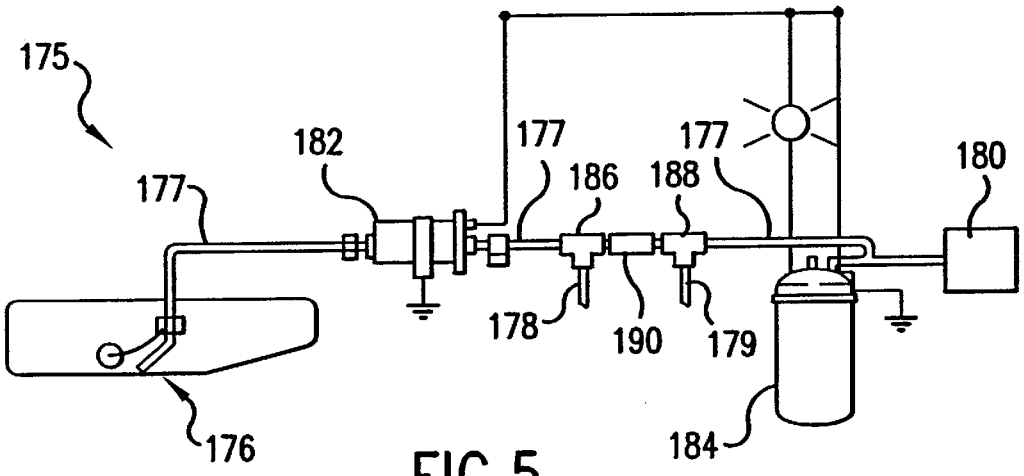

As a second example, the use of lubrication line 178 and return line 179 can be used with engine system 175 (FIG. 5). In this system, fuel supply line 177 extends between fuel tank 176 and injector pump 180. An electric solenoid pump 182 and a filter water separator/coalescer 184 are provided along fuel line 177. Connectors 186, 188 are provided downstream of pump 182 to couple lubrication and return lines 178, 179 to fuel supply line 177. One-way valve 190 is preferably provided between connectors 186 and 188 to prevent reverse flow of the fuel used as a lubricant to the fuel tank or to the lubrication system.

As the above description is merely exemplary in nature, being merely illustrative of the invention, many variations will become apparent to those of skill in the art. Such variations, however, are included within the spirit and scope of this invention as defined by the following appended claims.

What is claimed is:

1. An engine system comprising:

a four-cycle, internal combustion engine including a combustion system and a lubrication system;

a single fuel tank for holding a reservoir of fuel, said fuel to be used as a combustive agent and a lubricant;

a first fluid path for transporting the fuel from said fuel tank directly to said lubrication system for lubricating the engine, said lubrication system including a lubricant pan for receiving and holding the fuel;

a second fluid path for transporting the fuel from said fuel tank directly to said combustion system for combustion;

a third fluid path for transporting the fuel in the lubricant pan of said lubrication system to said combustion system for combustion; and a valve preventing the flow of fuel from the lubricant pan and through the third fluid path when the fuel reaches a certain minimum depth in the lubricant pan.

2. The engine system of claims 1 in which said first fluid path includes a first fuel line fluidly coupled to a lubricant pan to feed fuel to said lubrication system.

3. The engine system of claim 2 further comprising a float valve in said pan to regulate the conveyance of fuel to said pan.

4. The engine system of claim 1 in which a fuel supply line is coupled between said fuel tank and said combustion system, a lubrication line is coupled between said fuel supply line and said lubrication system, and a return line is coupled between said lubrication system and said fuel supply line.

5. The engine system of claim 4 in which said return line is fluidly coupled to a lubricant pan to draw fuel from said lubrication system.

6. The engine system of claim 4 which further comprises a one-way valve between the connection of the return line with the fuel supply line and the connection of the lubrication line with the fuel supply line.

7. The engine system of claim 4 in which said fuel supply line includes a pump to pump fuel from said fuel tank through both said fuel supply line and said lubrication line.

8. The engine system of claim 1 further comprising a first valve assembly for regulating the flow of fuel from said lubrication system and to said combustion system.

9. The engine system of claim 8 further comprising a timer to activate said valve assembly at spaced intervals so as to periodically move fuel from said lubrication system and to said combustion system.

10. The engine system of claim 8 further comprising a second valve assembly for regulating the flow of fuel to said lubrication system.

11. The engine system of claim 10 further comprising a timer to periodically activate said first and second valve assemblies to incrementally feed fuel into and out of said lubricating system.

12. The engine system of claim 1 which further comprises a sensor which senses a predetermined low volume limit of fuel in said lubrication system, and a valve which is activated by said sensor to prevent fuel from being drawn from said lubrication system.

13. The engine system of claim 1 in which the lubricant system is without a filter for filtering the fuel used to lubricate the engine.

14. A method of operating a four-cycle internal combustion engine having a lubrication system, the method comprising:

holding a reservoir of fuel in a single fuel tank;

feeding said fuel from said fuel tank directly to a combustion system for a four-cycle, internal combustion engine for combustion;

feeding said fuel from said fuel tank directly to a lubrication system in said engine for lubricating said engine, the lubrication system including a lubricant pan for receiving and holding the fuel;

feeding said fuel from said lubrication system to said combustion system for combustion; and preventing the flow of fuel from the lubricant pan to the combustion system when the fuel in the lubricant pan reaches a certain minimum depth.

15. The method of claim 14 wherein said removing of said fuel from the lubrication system is performed at spaced apart intervals.

16. The method of claim 15 wherein said feeding of fuel to said lubrication system is performed at spaced apart intervals.

17. The method of claim 16 wherein generally equal amounts of fuel are added and removed from said lubrication system at said spaced apart intervals.

18. The method of claim 14 wherein said feeding of fuel to said lubrication system is regulated by a float valve.

19. The method of claim 14 in which the fuel has a viscosity in the range of about 1.5 to 4.5 centistokes.

20. An engine system comprising: a four-cycle, internal combustion engine including a combustion system and a lubrication system;

a single fuel tank for holding a reservoir of fuel, said fuel to be used as a combustive agent and a lubricant;

a fluid path for transporting the fuel from said fuel tank directly to a lubricant pan in said lubrication system;

another fluid path for transporting the fuel from the lubricant pan to said combustion system for combustion; and a valve preventing the flow of fuel from the lubricant pan to the combustion system when the fuel reaches a certain minimum depth in the lubricant pan.

21. The engine system of claim 20 in which the lubricant system is without a filter for filtering the fuel used to lubricate the engine.

22. The engine system of claim 21 further including a filter in said another fluid path.

23. The engine system of claim 22 further including a fuel pump in said another fluid path.

* * * * *